United States Patent [19]

Hyman et al.

[11] Patent Number: 4,911,440

[45] Date of Patent: Mar. 27, 1990

[54] BALANCING BOARD

[75] Inventors: Greg Hyman, Pound Ridge, N.Y.; Craig Hollenback, Cos Cob, Conn.

[73] Assignee: Greg Hyman Associates, Inc., Pound Ridge, N.Y.

[21] Appl. No.: 351,933

[22] Filed: May 15, 1989

[51] Int. Cl.[4] ..... A63B 7/08

[52] U.S. Cl. ..... 272/146; 272/111

[58] Field of Search ..... 272/30, 54–56, 272/146, 111, 96; 446/75; D21/193, 227, 235, 251; 280/87.041, 28.5, 29

[56] References Cited

U.S. PATENT DOCUMENTS

| | | | |
|---|---|---|---|
| 2,764,411 | 9/1956 | Washburn, Jr. | 272/146 |
| 2,829,891 | 4/1958 | Ludwig | 272/146 |
| 3,630,540 | 12/1971 | Smith | 272/146 X |
| 4,505,477 | 3/1985 | Wilkinson | 272/146 |
| 4,601,469 | 7/1986 | Sasser, Jr. | 272/146 |

FOREIGN PATENT DOCUMENTS

| | | | |
|---|---|---|---|
| 1419409 | 10/1965 | France | 272/111 |

*Primary Examiner*—Richard J. Apley
*Assistant Examiner*—D. F. Crosby
*Attorney, Agent, or Firm*—Darby & Darby

[57] ABSTRACT

Balancing board device formed of a roller, a treadle board normally resting on the roller and a connector releasably interconnecting the board and roller, the connector including a first part on the board and a second part on the roller, the parts being substantially rigid and inflexible and normally arranged in coactive connection at a location completely within the roller outline for maintaining the roller substantially perpendicular to the longitudinal axis of the board and permitting limited relative longitudinal movement between the board and roller and rocking movement of the board on the roller while preventing separation of the roller from the board, and a release mechanism permitting disconnection of the parts for separation of the roller from the board.

15 Claims, 3 Drawing Sheets

BALANCING BOARD

FIELD AND BACKGROUND OF THE INVENTION

The present invention relates to a balancing board, and more particularly to a roller and treadle board device in which the board rests on and is releasably interconnected to the roller for safe and convenient exercise and amusement purposes.

Rudimentary seesaws or rockers are known, but there is no relative linear movement between their elements.

Specifically, U.S. Pat. No. 253,571 to Adams, and U.S. Pat. No. 1,865,612 to Bustillos, show collapsible seesaws in which angular side members are fixedly hingedly interconnected with a flat stationary fulcrum base to form a one piece triangular unit which can be folded for storage.

Also, U.S. Pat. No. 357,577 to Cashin shows a pair of hinged side arms removably mounted in a central rocker to form a seesaw, while U.S. Pat. No. 2,198,947 to Olson shows a collapsible seesaw in which a flat, lockable multiple section board is pivoted on a fulcrum base, yet when unlocked the board is foldable on itself in hinged sections, although it remains fixedly pivotally connected to the base.

U.S. Pat. No. 3,833,215 to Isdith shows a balancer device in which a roller is fixedly pivotally connected to a U-shaped cross bar on which a user may stand to operate the device, there being no relative movement between the roller and cross bar, such that the device performs as a kind of rolling seesaw.

On the other hand, balancing boards are also known, in which there is relative movement between the elements.

Thus, U.S. Pat. No. 2,764,411 to Washburn, Jr. shows a roller having a circumferential groove and a board containing a longitudinal track on its underside which fits in the groove for effecting the usual relative longitudinal movement between the roller and board and rocking movement of the board on the roller, the track having end stops to keep the board from rolling off the roller. However, there is no interconnection between these two separate elements.

U.S. Pat. No. 3,488,049 to Sasser, Jr., and U.S. Pat. No. 3,895,794 to England, show similar two element arrangements in which the roller merely rides in a flat or arched longitudinal recess in the underside of the board, the ends of the recess acting as stops to keep the board from rolling off the roller, but the two separate elements are not interconnected.

U.S. Pat. No. 2,829,891 to Ludwig shows a roller having a circumferential groove and a board containing a longitudinal hollow track on its underside which fits in the groove for effecting the usual relative longitudinal movement between the roller and board and rocking movement of the board on the roller, a rope being wound around the roller groove and disposed along the hollow track such that its ends are hand held by the user standing on the board to control movement and keep the board from rolling off the roller. However, there is no mechanical interconnection between the separate board and roller.

U.S. Pat. No. 4,601,469 to Sasser, Jr. shows a hollow roller and a board containing a longitudinal recess on its underside in which the roller is received, the recess end walls acting as stops preventing the board from rolling off the roller, and the recess side walls having parallel channels for receiving the ends of a straight pin or cranked and flexible pin passing through the hollow roller to connect the roller to the board.

In the case of the Sasser, Jr. straight pin, this connection is more or less permanent, since the roller ends and pin ends must closely abut the recess side walls and blind inner ends of the channels, respectively, to prevent sidewise wobble and yaw of the board relative to the roller during use, such that a special opening in one recess side wall and leading to its channel must be used to insert the straight pin via that channel through the hollow roller until it is seated in the opposite channel. Once inserted, it is difficult and time consuming to realign the pin with the opening, given the confined space involved, for removal to separate the three elements, and once separated they are apt to go astray.

In the case of the Sasser, Jr. cranked end flexible pin, such an opening cannot be used to assemble the three elements. Instead, the pin must be flexible so that after inserted in the hollow roller it may be bended to distort its ends into the side wall channels. However, the roller is shown to be shorter than the recess width, apparently to provide room for such manipulation, given the confined space involved, such that the roller ends do not closely abut the recess side walls, and thus cannot prevent sidewise wobble and yaw of the board relative to the roller during use. Here also, once inserted, it is difficult and time consuming to bend the pin in such confined space for release to separate the three elements, and once separated they are apt to go astray.

U.S. Pat. No. 3,630,540 to Smith shows a roller having a circumferential groove and a board containing, inter alia, a longitudinal flexible coil spring or rod on its underside which is interconnected with the roller at its groove. In the case of the spring, a longitudinal track fits in the roller groove to keep the roller in proper alignment with the board, and the spring ends are permanently attached to the board while its middle span extends around the groove underside to provide a temporary interconnection only to the extend that its positive tension prevents the roller from becoming detached. However, the spring is subject to constant wear since the groove rubs against its middle span continuously during use.

In the case of the Smith longitudinal flexible rod, its ends are also permanently attached to the board while its middle span is journalled in a bore in a bracket rotatably mounted on the roller, so as to provide a permanent interconnection with the roller. However, there is no longitudinal track to fit in the roller groove to keep the elements in proper alignment during use, as with the spring arrangement. Hence, the roller is subject to sidewise wobble and yaw as the board moves relative thereto, since the rod is flexible, and this will in turn subject the journal interconnection between its middle span and the bracket bore to constant sliding stress and twisting in all directions as well as to high wear.

It would be desirable to provide a balancing board device of the above type, composed of only two relatively movable elements, which are interconnnected for use without sidewise wobble or yaw or fear of undesired separation, yet which may be readily separated for self-contained transport or storage.

SUMMARY OF THE INVENTION

It is an object of this invention to provide a balancing board device having a roller and a treadle board as the only two relatively movable elements, which are operatively interconnected in a locally confined zone by substantially rigid and inflexible connecting parts for efficiently maintaining the roller substantially perpendicular to the longitudinal axis of the board and permitting limited relative longitudinal movement between the board and roller and rocking movement of the board on the roller while preventing separation of the two elements, yet which interconnection is readily releasable for separating the two elements when desired.

It is another object of this invention to provide such a device, which upon separation of the two elements permits their formation into a compact self-contained package for transport or storage, thus preventing the elements from going astray.

According to this invention, a balancing board device is advantageously provided which comprises a roller, a treadle board extending along a longitudinal axis and having an underside normally in contact with the roller, and a connector for releasably interconnecting the board and roller.

The connector includes a first part mounted on the board and a second part mounted on the roller and disposed completely within the roller outline. The outline is defined as a circular cylinder terminating at two end portions substantially perpendicular to the longitudinal axis of the cylinder. The parts are substantially rigid and inflexible and normally arranged in coactive connection at a location completely within the roller outline to maintain the roller substantially perpendicular to the longitudinal axis and permit limited relative longitudinal movement between the board and roller and rocking movement of the board on the roller, while preventing separation of the roller from the board.

Release means are also provided to permit disconnection of the parts for separation of the roller from the board.

More particularly, the roller has a circumferential groove, the first part is a longitudinal guide stationarily mounted on the board underside and in engagement with the groove in any movement position of the board relative to the roller, and having end stops for stopping the roller at the guide ends, and the second part is a keeper rotatably mounted on the roller in the groove and in captive loosely slidable connection with the guide in any such movement position.

According to one desirable feature, the keeper has a sleeve rotatably mounted on the roller, a follower stationarily mounted on and generally radially extending from the sleeve and in such captive loosely slidable connection with the guide, and a counterweight stationarily mounted on and generally radially depending from the sleeve in opposed balancing relation to the follower to maintain the follower in upright disposition for inhibiting binding contact between the follower and guide.

According to another desirable feature, the guide has a pair of opposed bilaterally outwardly directed substantially rigid and inflexible longitudinal tracks, and the keeper has a pair of opposed bilaterally inwardly directed substantially rigid and inflexible follower arms in captive loosely slidable travel connection with the tracks.

Thus, the guide and keeper are advantageously normally arranged in substantially stress free and friction free coactive loosely slidable travel connection with each other.

According to a preferred feature, the board includes at least two tandem panels hingedly connected for pivotal movement about a corresponding hinge axis from a normal substantially coplanar position of the panels along the longitudinal axis to an angular position, the panel undersides containing corresponding tandem sections of the first part. These sections form the release means permitting disconnection of the parts upon moving the panels to angular position to space the sections apart at the hinge axis.

More specifically, the longitudinal guide is in the form of such tandem sections on the panel undersides, with the guide sections being compositely in engagement with the roller groove in any movement position of the board relative to the roller, and with the roller end stops being at the composite guide section ultimate ends. Thus, the guide is interrupted at the location of the given hinge axis, and becomes exposed upon panel movement to angular position, for defining a longitudinal release opening between the sections thereat for disconnecting the keeper from the guide.

Conveniently, a lock is provided for releasably locking the panels against such movement to angular position. For this purpose, adjacent panel ends may contain aligned facing locking recesses at the corresponding hinge axis, and the lock may comprise a spanning wedge sized for locking insertion removably in the recesses in spanning relation to the hinge axis when the panels are in coplanar position to prevent their movement to angular position.

Alternatively, such panel ends may contain aligned parallel bores adjacent the hinge axis, and the lock may comprise a U-shaped spanning clip sized for locking insertion of its ends removably in the bores in spanning relation to the hinge axis when the panels are in coplanar position to prevent their movement to angular position.

Preferably, the board includes three tandem panels selectively sized relative to the roller diameter and comprising a pair of end panels correspondingly hingedly connected to a middle panel, such that upon pivotal movement of the end panels toward each other, a hollow triangular enclosure is provided in which the roller is securely insertable to form a compact self-contained package for transport or storage. The end panels may be advantageously provided with handles at the outer edges of the board and arranged to meet at an apex of the triangular enclosure upon such movement of the end panels, for enabling the package to be hand carried.

BRIEF DESCRIPTION OF THE DRAWINGS

Other objects of the invention will become apparent from the within specification and accompanying drawings, in which.

DESCRIPTION OF THE PREFERRED EMBODIMENTS

Figure 1:
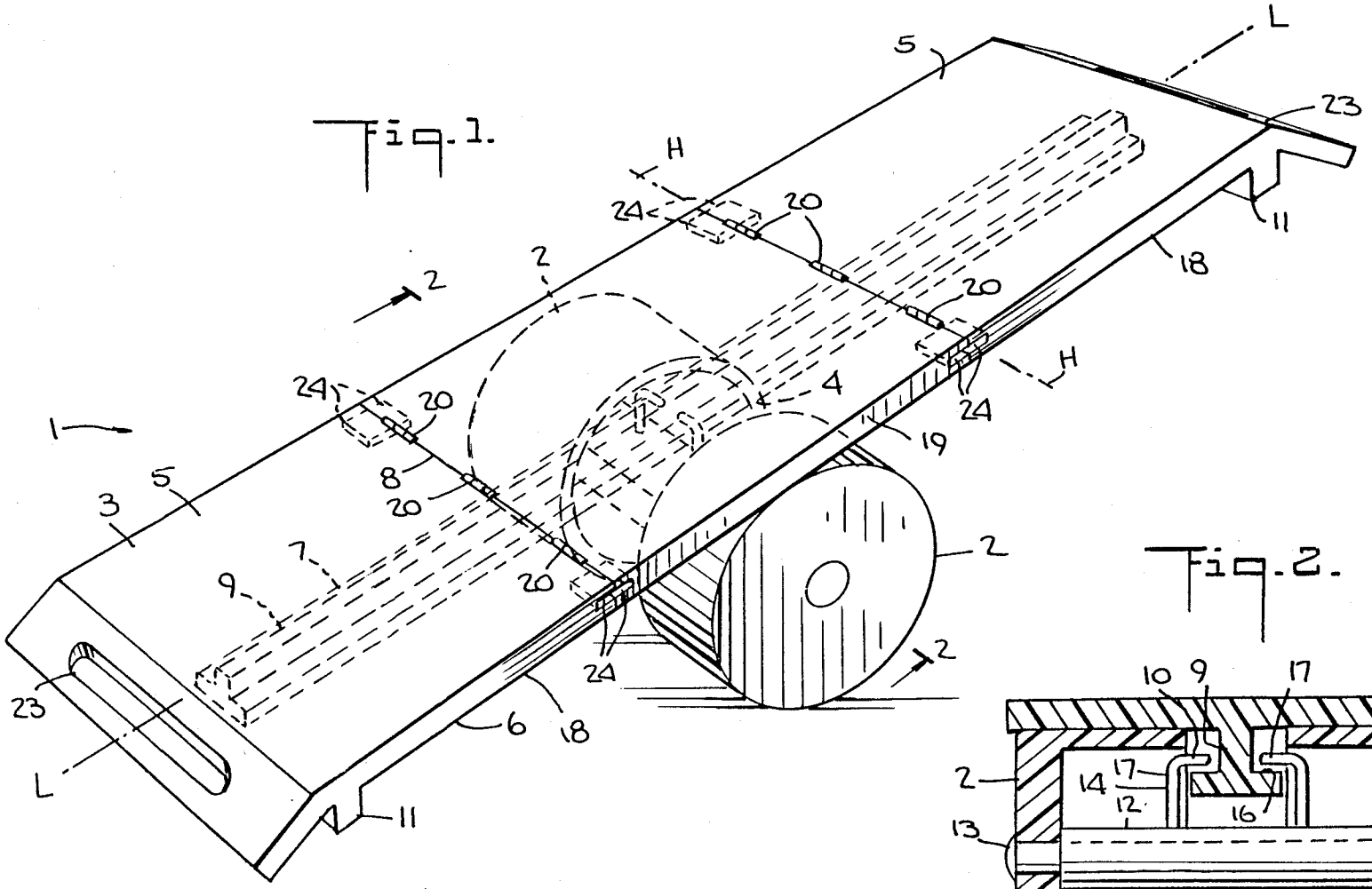
FIG. 1 is a schematic perspective view of the balancing board device according to one embodiment of the invention.

Referring to the drawings, and initially to FIGS. 1–4, a balancing board device 1 is shown, according to one embodiment of the invention, which is composed of only two separate elements, namely roller 2 and treadle board 3. Roller 2 has a circumferential groove 4, and board 3 extends along a longitudinal axis L and has an upper side 5 on which the user stands and an underside 6 normally in contact with roller 2. Roller 2 and board 3 are releasably interconnected by connector 7, in conjunction with release means 8 permitting their separation.

Connector 7 includes a first part 9 in the form of a longitudinal guide stationarily mounted on underside 6, and a second part 10 in the form of a keeper freely rotatably mounted on roller 2, i.e. mounted on roller 2 for free relative rotation with respect to roller 2, and disposed completely within the roller outline, these parts being substantially rigid and inflexible and normally arranged in coactive connection at a location completely within the roller outline to maintain roller 2 substantially perpendicular to axis L and permit limited relative longitudinal movement between board 3 and roller 2 and rocking movement of board 3 on roller 2, while preventing separation of roller 2 from board 3.

On the other hand, release means 8 permit disconnection of these parts to separate roller 2 from board 3 when desired.

Guide 9 is arranged in close fit sliding travel engagement with groove 4 in any movement position of board 3 relative to roller 2, and has end stops 11 for stopping roller 2 at the guide longitudinal ends, while keeper 10 is disposed in groove 4 in captive loosely slidable travel connection with guide 9 in any such movement position of roller 2 and board 3.

Figure 2:
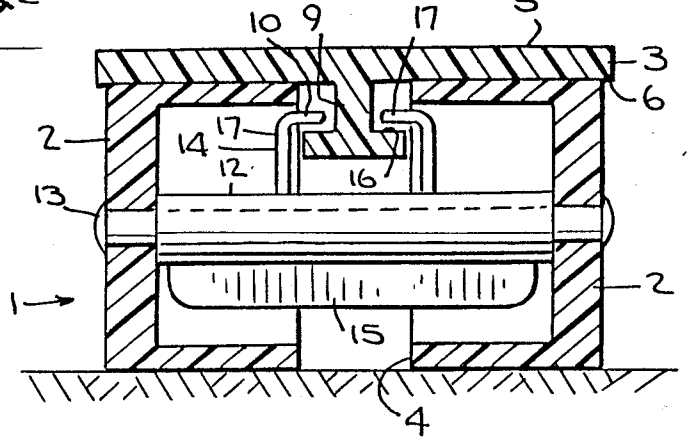
FIGS. 2 is a sectional view taken along line 2—2 of FIG. 1.

Keeper 10 has a sleeve 12 rotatably mounted on roller axle 13, a follower 14 stationarily mounted on and extending radially from sleeve 12 and arranged in captive loosely slidable travel connection with guide 9, and a counterweight 15 stationarily mounted on and radially depending from sleeve 12 in opposing balancing relation to follower 14 to maintain follower 14 in upright disposition to inhibit binding contact between loosely associated follower 14 and guide 9 (FIG. 2).

More particularly, guide 9 is in the form of an inverted T-rail or T-beam, which is fixed to underside 6 and which has a pair of opposed bilaterally outwardly directed substantially rigid and inflexible longitudinal tracks 16, while keeper 10 has a pair of opposed bilaterally inwardly directed substantially rigid and inflexible follower arms 17 in captive loosely slidable connection with tracks 16, with appropriate vertical or radial clearance between arms 17 and the upper and lower surface confines of tracks 16, such confines more particularly constituting downwardly facing underside 6 and the upwardly facing upper side of tracks 16, as formed by the horizontal portion of the inverted T-rail or T-beam shaped guide 9.

By the above construction, the rigid and inflexible guide 9 and keeper 10 are normally arranged in substantially stress free and friction free coactive loosely slidable travel connection at and in groove 4, for minimum wear operation of the device while preventing sidewise wobble or yaw during relative longitudinal movement between roller 2 and board 3 within the limits of end stops 11, as well as during rocking movement of board 3 on roller 2, all safely without fear of undesired separation of roller 2 from board 3.

In essence, the full force of the user standing on upper side 5 of board 3 during operation of device 1 is transmitted directly via underside 6 to the periphery of roller 2, and the only friction involved is rolling friction between the race constituted by underside 6 and the roller periphery as roller 2 rolls along the ground or other support surface on which device 1 is used, and rolling friction between the counterpart race constituted by the bilaterally outwardly facing slide surface side edges of the boundary male outline of guide 9 and the bilaterally inwardly facing slide surface side edges of the boundary female outline of roller groove 4 (FIG. 2).

Figure 3:
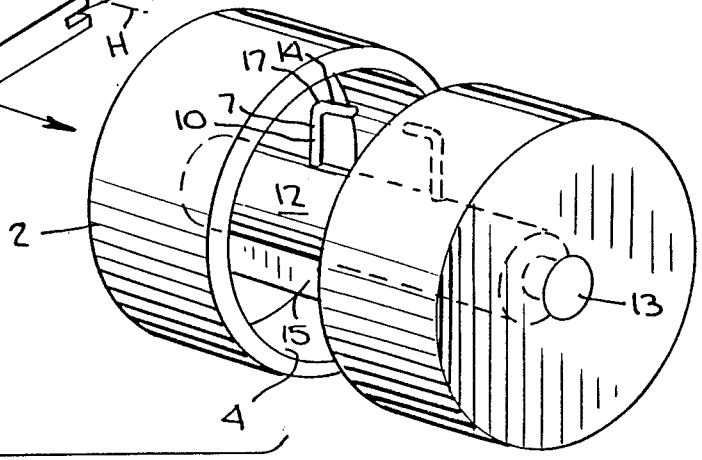
FIG. 3 is a perspective view of the device of FIG. 1 with the roller released from connection with the board and arranged to provide a self-contained package for transport or storage.
Figure 3:
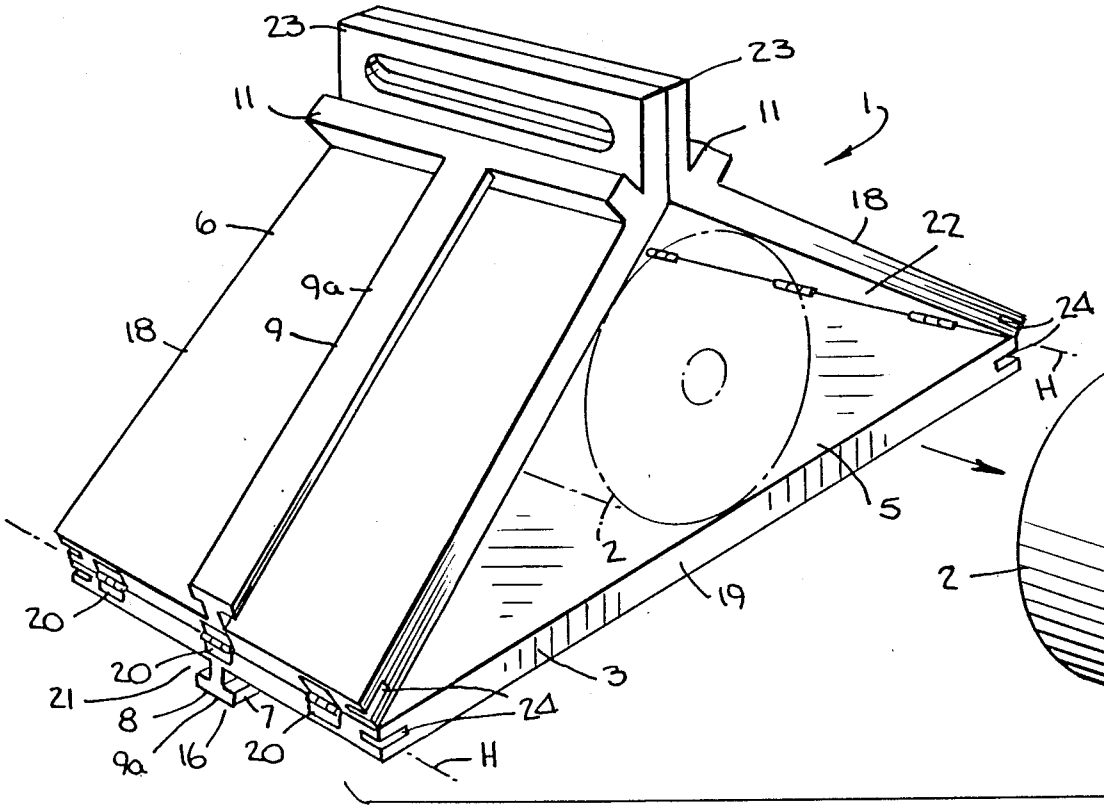

Board 3 is divided into three tandem arranged panels, including two end panels 18 and a middle panel 19, which are hingedly connected by hinges 20 for pivotal movement about the corresponding hinge axes H, from a normal substantially coplanar position of the panels along longitudinal axis L (FIG. 1), to an angular position thereof (FIG. 3). Thus, guide 9 is actually provided on the undersides of panels 18,18,19 as three corresponding individual tandem guide sections 9a.

These guide sections 9*a* conveniently form release means 8, since the guide is interrupted at the location of the corresponding hinge axis H. Hence, upon moving the panels to angular position to space the sections 9*a* apart at the corresponding hinge axis H, the guide is exposed to define a longitudinal release opening 21 between the sections 9a thereat permitting keeper 10 to be disconnected from guide 9 (FIG. 3).

Significantly, panels 18,18,19 are selectively sized relative to the diameter of roller 2, such that upon pivotal movement of end panels 18 toward each other, a hollow triangular enclosure 22 is formed in which roller 2 may be securely inserted, as shown in phantom in FIG. 3, to form a compact self-contained package for transport or storage. For this purpose, end panels 18 may be provided with handles 23 outwardly of end stops 11 at the outer edges of board 3 and arranged to meet at an apex of triangular enclosure 22 upon such angular movement of end panels 18, for hand carrying of the package.

Figure 4:
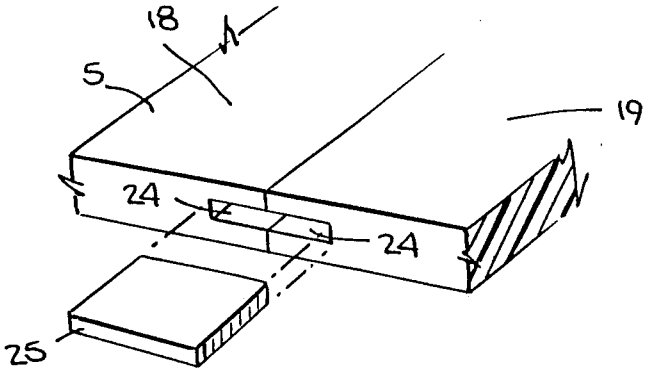
FIG. 4 is a perspective view of part of the device of FIG. 1, illustrating one locking system for the board panels.

To keep the three panels in normal coplanar position along longitudinal axis L, lock means are conveniently provided for releasably locking them against movement to angular position. For this purpose, as shown in FIGS. 1, 3 and 4, the adjacent ends of corresponding panels are provided with aligned facing locking recesses 24 at the corresponding hinge axis H, and a spanning wedge 25 sized for locking insertion removably in a given pair of these facing recesses 24 in spanning relation to the hinge axis H thereat, when the panels are in coplanar position, is provided so as to lock the panels and prevent their movement to angular position.

Figure 5:
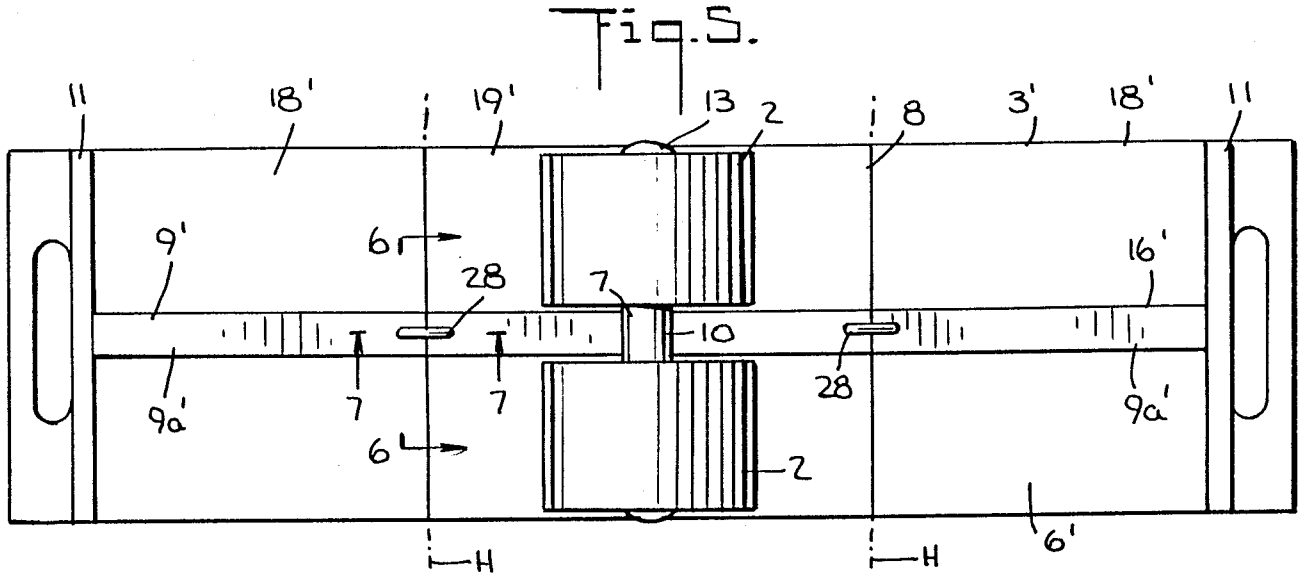
FIG. 5 is a schematic view of the underside of the device according to a modified locking system embodiment of the invention.
Figure 7:
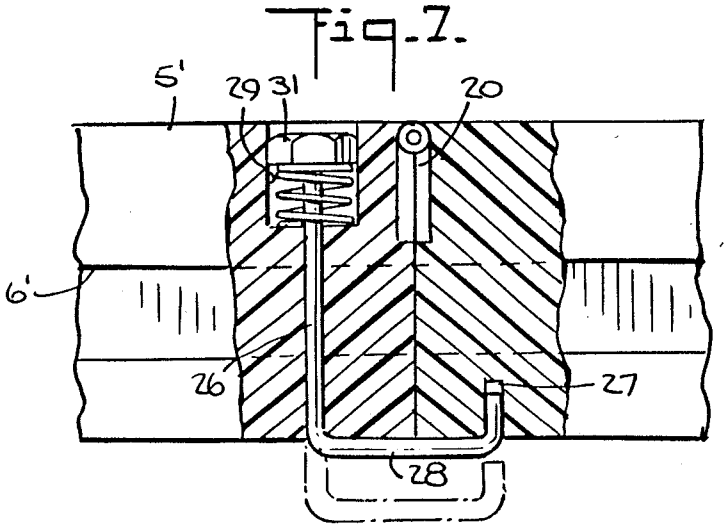
FIGS. 6 and 7 are schematic sectional views taken along lines 6—6 and 7—7, respectively, of FIG. 5, but inverted to illustrate the orientation, relative to the board upper side, of details of the modified locking system for the board panels.
Figure 6:
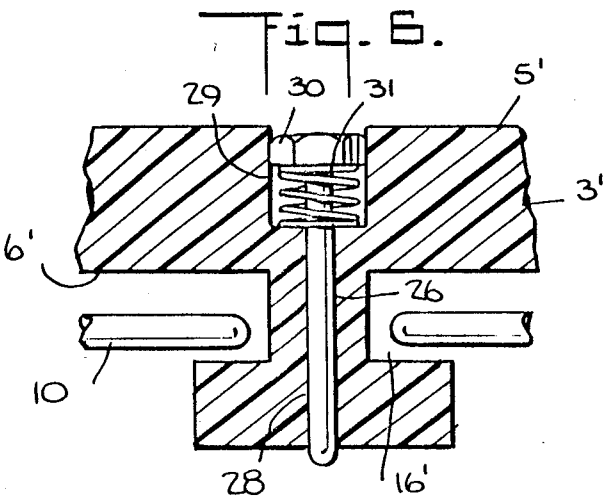

FIGS. 5–7 show a modified embodiment of the device locking means for the panels of FIGS. 1–3, in which all parts are assigned the same reference numerals as used in FIGS. 1–3 except those relating to the modification, and as to the latter the corresponding parts are assigned prime (') designations or new reference numerals.

In this modified embodiment, the adjacent ends of panels 18' and 19', as the case may be, are provided in their undersides with aligned parallel bores 26 and 27 adjacent the corresponding hinge axis H, and a U-shaped spanning clip 28 sized for locking insertion of its ends removably in bores 26 and 27 in spanning relation to the hinge axis H thereat, when the panels are in coplanar position, is provided so as to lock the panels against movement to angular position.

For automatic operation, the longer end of clip 28 extends through longer bore 26 to a hexagonal cavity 29 defined in the upper side 5' of board 3' where it is fixed to a hexagonal nut 30 loaded by a return coil spring 31 in upward direction, so as to keep clip 28 in engagement with the underside of guide 9' thereat and the shorter end of clip 28 in shorter bore 27, thereby connecting the adjacent panels against pivotal movement at the adjacent hinge 20 about its axis H. To release this lock means, downward finger pressure on the top of nut 30 is used to displace clip 28 against the force of return spring 31 until the short end of clip 28 clears the short bore 27.

Of course, it will be understood that any other suitable lock means may be used to prevent undesired movement of the panels from coplanar position to angular position.

In operation, the user straddles the upper surface of board 5 or 5' as it rests in normal contact with roller 2, when the two elements are interconnected by the connector, for use in the usual way for exercise or amusement, the arrangement being such that the roller and board may freely move relative to each other in longitudinal direction within the limits of the end stops and without sidewise wobble or yaw, and the board may freely rock on the roller under the same constrictions, with the two elements being kept safely interconnected.

This safe and efficient operation is possible because of the close sliding fit between the board guide and roller groove, and the loose slidable captive travel connection between the guide and keeper in the groove, entirely protectively within the roller outline, and because the full weight of the user is transmitted directly via the board underside to the roller periphery without fear of undesired separation of the elements.

It will be seen that in both embodiments, the hinge connections between the panels are located at the board upper side, and are arranged such that the facing ends of adjacent panels as well as the facing ends of adjacent guide sections are normally in corresponding coactive reinforcing abutment when the panels are in coplanar position, thereby providing gap free seams at such abutting ends, offering no hindrance to free rolling movement of the roller back and forth along the panel undersides and of the keeper along the guide sections.

On the other hand, to fold the device, the lock means are merely removed to free the panels for pivoting about their hinges to triangular enclosure configuration, whereupon the keeper may be removed from the adjacent guide section via the thereby defined longitudinal release opening to separate the roller from the board, and the roller then inserted into that enclosure to form the hand carrying package.

The use of a foldable panel treadle board arrangement is preferred, not only because it permits convenient collapse and folding of the device into a self-contained package, but also because it advantageously inherently provides a safely usable release means automatically permitting separation of the roller from the board, but only when the device is not in use. However, if desired, alternate forms of release means may be used to permit separation of the roller from the board.

It will be understood that the various device components may be made of any suitable material, although it is convenient to make them of rigid and inflexible plastic, except for the hinges, roller axle and keeper which are preferably made of or reinforced by metal to withstand safely the dynamic forces acting on the device. Thus, the device may be made efficiently from a minimum of components of serviceable, simple and inexpensive construction.

It will be appreciated that the foregoing specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. A balancing board device comprising a roller, a treadle board extending along a longitudinal axis and having an underside normally in contact with the roller, and a connector for releasably interconnecting the board and roller, the connector including a first part mounted on the board and a second part mounted on the roller and disposed completely within the roller outline, the parts being substantially rigid and inflexible and normally arranged in coactive connection at a location completely within the roller outline for maintaining the roller substantially perpendicular to the longitudinal axis and permitting limited relative longitudinal movement between the board and roller and rocking movement of the board on the roller while preventing separation of the roller from the board, and release means permitting disconnection of the parts for separation of the roller from the board.

2. Device of claim 1 wherein the roller has a circumferential groove, the first part is a longitudinal guide stationarily mounted on the board underside and in engagement with the groove in any movement position of the board relative to the roller, and having end stops for stopping the roller at the ends of the guide, and the second part is a keeper rotatably mounted on the roller in the groove and in captive loosely slidable connection with the guide in any said movement position.

3. Device of claim 2 wherein the keeper has a sleeve rotatably mounted on the roller, a follower stationarily mounted on and generally radially extending from the sleeve and in captive loosely slidable connection with the guide, and a counterweight stationarily mounted on and generally radially depending from the sleeve in opposed balancing relation to the follower for maintaining the follower in upright disposition for inhibiting binding contact between the follower and guide.

4. Device of claim 2 wherein the guide has a pair of opposed bilaterally outwardly directed substantially rigid and inflexible longitudinal tracks, and the keeper has a pair of opposed bilaterally inwardly directed substantially rigid and inflexible follower arms in captive loosely slidable connection with the tracks.

5. Device of claim 2 where the guide and keeper are normally arranged in substantially stress free and friction free coactive loosely slidable connection with each other.

6. Device of claim 1 wherein the board includes at least two tandem panels hingedly connected for pivotal movement about a corresponding hinge axis from a normal substantially coplanar position of the panels along the longitudinal axis to an angular position thereof, the undersides of the panels containing corresponding tandem sections of the first part forming the release means permitting disconnection of the parts upon moving the panels to said angular position to space the sections apart at the hinge axis.

7. Device of claim 6 wherein a lock is provided for releasable locking the panels against movement to said angular position.

8. Device of claim 7 wherein the adjacent ends of the panels are provided with aligned facing locking recesses at the corresponding hinge axis, and the lock comprises a spanning wedge sized for locking insertion removably in the recesses in spanning relation to the hinge axis when the panels are in said coplanar position to prevent panel movement to said angular position.

9. Device of claim 7 wherein the adjacent ends of the panels are provided with aligned parallel bores adjacent the corresponding hinge axis, and the lock comprises a U-shaped spanning clip sized for locking insertion of its ends removably in the bores in spanning relation to the hinge axis when the panels are in said coplanar position to prevent panel movement to said angular position.

10. Device of claim 6 wherein the roller has a circumferential groove, the first part is a longitudinal guide stationarily mounted on the board underside in the form of corresponding tandem sections on the panel undersides and in engagement with the groove in any movement position of the board relative to the roller, and having end stops for stopping the roller at the ends of the guide, and the second part is a keeper rotatably mounted on the roller in the groove and in captive loosely slidable connection with the guide in any said movement position, the guide being interrupted at the location of said hinge axis for defining a longitudinal release opening between the sections thereat for disconnecting the keeper from the guide upon moving the panels to said angular position.

11. Device of claim 10 wherein the keeper has a sleeve rotatably mounted on the roller, a follower stationarily mounted on and generally radially extending from the sleeve and in captive loosely slidable connection with the guide, and a counterweight stationarily mounted on and generally radially depending from the sleeve in opposed balancing relation to the follower for maintaining the follower in upright disposition for inhibiting binding contact between the follower and guide.

12. Device of claim 10 wherein the guide has a pair of opposed bilaterally outwardly directed substantially rigid and inflexible longitudinal tracks, and the keeper has a pair of opposed bilaterally inwardly directed substantially rigid and inflexible follower arms in captive loosely slidable connection with the tracks.

13. Device of claim 10 wherein the guide and keeper are normally arranged in substantially stress free and friction free coactive loosely slidable connection with each other.

14. Device of claim 6 wherein the board includes three tandem panels selectively sized relative to the roller diameter and comprising a pair of end panels correspondingly hingedly connected to a middle panel, such that upon pivotal movement of the end panels toward each other, a hollow triangular enclosure is provided in which the roller is securely insertable to form a compact self-contained package for transport or storage.

15. Device of claim 14 wherein the end panels have handles at the outer edges of the board and arranged to meet at an apex of the triangular enclosure upon said movement of the end panels, for enabling the package to be hand carried.

* * * * *